United States Patent [19]

Lammert et al.

[11] Patent Number: 4,902,142

[45] Date of Patent: Feb. 20, 1990

[54] ADHESIVE TAPE AS RECLOSEABLE CLOSURE

[75] Inventors: Rolf Lammert, Bönningstedt; Friedrich Rambow, Hamburg; Cort Herager, Birker d, all of Fed. Rep. of Germany

[73] Assignee: Beiersdorf Aktiengesellschaft, Hamburg, Fed. Rep. of Germany

[21] Appl. No.: 190,543

[22] Filed: May 5, 1988

[30] Foreign Application Priority Data

May 5, 1987 [DE] Fed. Rep. of Germany ..... 3714843

[51] Int. Cl.[4] ..... B65D 33/20

[52] U.S. Cl. ..... 383/78; 383/181; 383/908; 206/610; 206/618; 206/632

[58] Field of Search ..... 383/5, 78, 87, 86, 84, 383/81, 66, 908; 206/604, 605, 610, 618, 616, 813, 632, 633, 609, 613, 617, 629; 229/123.2, DIG. 5

[56] References Cited

U.S. PATENT DOCUMENTS

| | | | |
|---|---|---|---|
| 1,180,541 | 4/1916 | Roden | 206/613 |
| 2,321,066 | 6/1943 | Dense et al. | 206/617 |
| 3,089,634 | 5/1963 | Heise et al. | 206/613 |
| 3,187,982 | 6/1965 | Underwood et al. | 206/613 |
| 3,295,744 | 1/1967 | Turpin et al. | 206/617 |
| 3,640,449 | 2/1972 | Bastian | 229/123.2 |
| 3,784,087 | 1/1974 | Styers . | |
| 3,980,224 | 9/1976 | Yasuda | 229/DIG. 5 |
| 4,509,196 | 4/1985 | Sak et al. | 383/5 |
| 4,567,987 | 2/1986 | Lepisto et al. . | |
| 4,572,377 | 2/1986 | Beckett | 206/632 |
| 4,702,646 | 5/1987 | Provost | 383/5 |
| 4,709,399 | 11/1987 | Sanders | 383/5 |
| 4,762,230 | 8/1988 | Croce | 206/609 |

FOREIGN PATENT DOCUMENTS

| | | |
|---|---|---|
| 0134130 | 3/1985 | European Pat. Off. . |
| 2507722 | 9/1976 | Fed. Rep. of Germany . |
| 2642121 | 3/1978 | Fed. Rep. of Germany . |
| 3234867 | 3/1984 | Fed. Rep. of Germany . |
| 752160 | 7/1956 | United Kingdom . |
| 2147564 | 5/1985 | United Kingdom . |
| 2177677 | 1/1987 | United Kingdom . |

*Primary Examiner*—Stephen Marcus
*Assistant Examiner*—Jes F. Pascua
*Attorney, Agent, or Firm*—Sprung Horn Kramer & Woods

[57] ABSTRACT

Adhesive tape for the recloseable closure of a tubular bag or the like, comprising a base, partly coated with an adhesive, having a lateral tab running in the longitudinal direction of the adhesive tape, characterized in that the base (2) continues, adjoining the tab (3), into a tear-open region (4), which, in the manner of an original closure, can be torn open in the longitudinal direction of the adhesive tape (1), and, adjoining thereto, continues into a further adhesive region (6) coated with adhesive (5*b*).

8 Claims, 1 Drawing Sheet

ADHESIVE TAPE AS RECLOSEABLE CLOSURE

Figure 1:
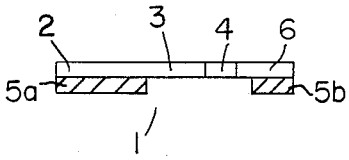

The invention relates to an adhesive tape for the recloseable closure of a tubular bag or the like, and its use as recloseable original closure and also tubular bags or the like which are equipped with such a closure. The invention relates in particular to an adhesive tape for a closure which, on the one hand, can be opened and reclosed repeatedly, but which, on the other hand, in the manner of an original closure, reveals at first glance whether this closure has already been opened or not.

The prior art discloses various types of recloseable closures which are also quite suitable for tubular bags or the like. For instance, European Patent Application A2 134 130 describes a tubular bag having an adhesive-tape closure which can be opened and closed repeatedly. In this case, the adhesive-tape closure is affixed over a longitudinal row of weak points in the tubular bag in such a way that a tab on this closure can be used to begin initially pulling off the closure from the tubular bag until the row of weak points is exposed, whereupon these weak points tear open and thus open the bag, exposing its contents.

The bag is closed again in the reverse sequence, the adhesive-tape closure is pressed into its original position onto the bag and thus reclosed. Such a closure system is available commercially under the name "tesa-seal".

Although such an adhesive-tape closure is quite sufficient for many practical applications, it does not adequately solve the problem of an original closure. This is so since an original closure is intended to show in a simple way whether a package, such as a tubular bag, has already been opened and closed again or not. Although, on closer inspection, the prior art adhesive-tape closure does indeed indicate that the closure has already been opened, by the already broken-open weak points, after a little practice it is possible to reseal the closure again so exactly that it is virtually impossible for an untrained person to determine whether the closure has already been opened. The high requirement demanded of an original closure can therefore not always be met by this known closure system.

The object of the invention was to remedy this situation, in particular to create an adhesive tape for the recloseable closure of a tubular bag or the like which at the same time indicates in an unequivocal way whether the closure has already been opened.

Consequently, the invention relates to an adhesive tape for the recloseable closure of a tubular bag or the like comprising a base coated with two laterally spaced longitudinal lines of adhesive and having a lateral tab running in the longitudinal direction of the adhesive tape, which is characterized in that the base continues, adjoining the tab, into a tear-open region, which, in the manner of an original closure, can be torn open in the longitudinal direction of the adhesive tape, and adjoining thereto, continues into a further adhesive region coated with adhesive.

With this adhesive tape according to the invention, both an original closure and a recloseable closure can be produced in a simple way for tubular bags and the like, which allows an untrained person to determine at first glance whether the closure has already been opened or not.

The base of the adhesive tape according to the invention preferably consists of a plastic film which, in particular for transparent tubular bags, can for its part be transparent and thus does not impair the appearance of the package. On the tab running in the longitudinal direction of the adhesive tape, instructions are advantageously printed as to how the closure is to be handled, for instance in which direction it is to be pulled and reclosed. The adhesive used is advantageously a self-adhesive, also transparent if appropriate. However, with suitable designing, adhesives of the hot-melt type or the like can also be used.

In the tear-open region, the beginning is advantageously designed as a tab, for instance by part of the tear-open region being torn into and bent forward, or else by a small piece of adhesive tape being affixed to the beginning, preferably coloured in a striking colour, or else also by printing a strong lacquer or the like on the beginning. Instructions for use may also be printed in the tear-open region, for instance in which direction to pull. The tear-open region is advantageously designed in such a way that a tear-open strip is underlaid in the longitudinal direction of the adhesive tape, with the aid of which strip the original closure is destroyed during tearing-open. It is also possible, however, for a perforation or slits, running in the longitudinal direction of the adhesive tape, to be provided in the tear-open region, along which perforation or slits tearing-open then takes place. Finally, the base of the adhesive tape itself may be designed to be particularly suitable for a tearing-open in the tear-open region by using a base which is highly stretched in the longitudinal direction of the adhesive tape, preferably a base of predominantly monoaxially stretched polypropylene.

Figure 2:
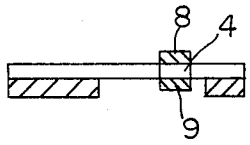
Figure 3:
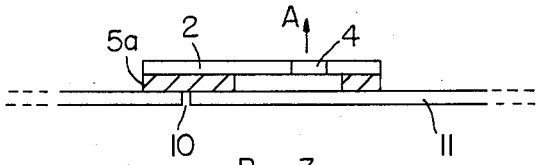
Figure 4:
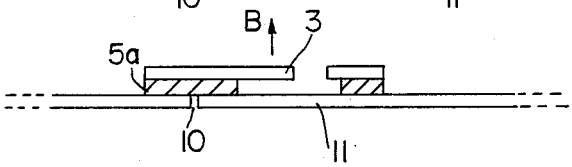
Figure 5:
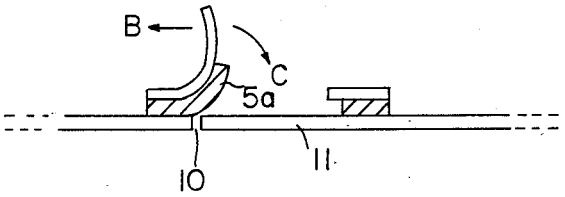
Figure 6:
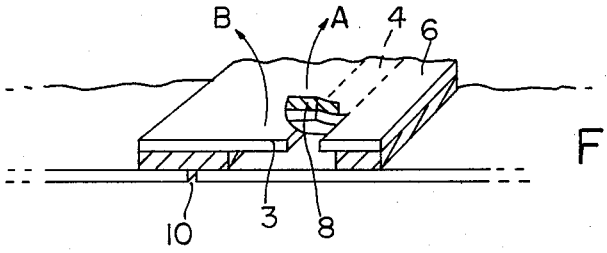

Advantageous developments of the adhesive tape according to the invention are represented in the drawings, in which specifically FIG. 1 shows a cross-section through an adhesive tape according to the invention, FIG. 2 shows a cross-section through a further embodiment of an adhesive tape according to the invention, FIG. 3 shows the cross-section of an adhesive tape according to the invention, affixed to a tubular bag, FIG. 4 shows the arrangement shown in FIG. 3, but the tear-open region has already been removed, FIG. 5 shows the article shown in FIGS. 3 and 4 in the open state, and FIG. 6 shows the diagrammatic representation of an adhesive tape according to the invention, affixed to a tubular bag.

The adhesive tape 1 according to the invention, shown in cross-section in FIG. 1, consists of a base 2 of monoaxially stretched polypropylene, stretched in the direction of the adhesive tape. The base 2 is partly coated with a self-adhesive 5*a* and 5*b* in such a way that a tab 3 and a tear-open region 4 remains free of adhesive. The tear-open region 4 is designed such that it can be torn open out of the base 2 by a series of longitudinally running slits. Adjoining the tear-open region 4 is an adhesive region 6, which bears the adhesive 5*b*.

The embodiment shown in FIG. 2 corresponds to the above description, but has, in the tear-open region at the beginning and on its surface, a small piece of affixed adhesive tape 8, which serves as tab. Underneath the tear-open region 4, a tear-open strip 9 is arranged which makes a reliable tearing-open of the base 2 possible without this base 2 according to this embodiment needing to be perforated or slitted in its tear-open region 4.

FIGS. 3–5 show the various stages of an adhesive tape according to the invention, FIG. 3 in the stage of the original closure and affixed to a tubular bag 11 with a longitudinal series of weak points 10, here designed as a longitudinal row of small slits. By pulling the tear-open region 4 in the direction of the arrow A, the base 2 is separated in such a way that the partly-open form shown in FIG. 4 remains. In this form, the tab 3 is then seized and pulled in the direction of arrow B. This causes the adhesive 5*a* to be lifted off the tubular bag 11, as shown in FIG. 5, and the longitudinal row of weak points 10, up until then covered by the adhesive 5*a*, to be exposed. With further pulling in the direction of arrow B, these weak points break open, the contents of the bag are accessible and opened. In the direction of arrow C, FIG. 5, the adhesive tape with an adhesive 5*a* is again pressed on to the tubular bag 11 and the latter is thereby closed, as shown in FIG. 4. In this form, it is readily evident to an observer that the original closure, as shown in FIG. 3, no longer exists and that rather the closure has already been opened, since the tear-open region 4 is missing. It is thus evident even to unskilled persons at first glance whether they are dealing with a package with original closure or not.

It is diagrammatic shown in FIG. 6 how an adhesive tape according to the invention, fitted as closure on a tubular bag, having a longitudinal row of weak points 10 and equipped with a tab at the beginning of the tear-open region 4, can be opened by pulling in the direction of arrows A and then B.

We claim:

1. Adhesive tape for the reclosable closure of a tubular bag or the like, comprising a base coated with a longitudinal line of adhesive and having a tab running in the longitudinal direction of the adhesive tape and laterally extending past said line adjoining the base of adhesive, the tab (3), continues into a tear-open region (4) which, in the manner of an original closure, can be torn open in the longitudinal direction of the adhesive tape (1), and the tear-open region, adjoining the tab, continues into adhesive region (6) coated with another longitudinal line of adhesive, the tear-open region being formed by strong stretching of the base in the longitudinal direction of the adhesive tape.

2. Adhesive tape according to claim 1, characterized in that the base is a transparent polypropylene plastic film and the longitudinal lines of adhesive is a self-adhesive.

3. Adhesive tape according to claim 1, characterized in that a beginning of the tear-open region is designed as a tab.

4. Adhesive tape according to claim 1, characterized in that the tear-open region is underlaid with a tear-open strip running in the longitudinal direction of the adhesive tape.

5. Adhesive tape according to claim 1, characterized in that the tear-open region has perforations or slits running in the longitudinal direction of the adhesive tape.

6. A container closed with an adhesive tape according to claim 1.

7. A container according to claim 6, wherein the container is a tubular bag having a longitudinal row of weak points, the base of the tape being affixed over such weak points, tearing of the base exposing the tab for opening, which opening tears the bag along the row of weak points, the torn line being visible even upon subsequent resealing.

8. A tape for the reclosable closure of a container having two spaced lines of adhesive, and a weakened tear strip between and spaced from at least one of the adhesive lines so that when the tear strip is torn from the tape there remains an adhesive-free strip laterally extending from said at least one of the adhesive lines for facilitating the opening and re-sealing of said container.

* * * * *

UNITED STATES PATENT AND TRADEMARK OFFICE

CERTIFICATE OF CORRECTION

PATENT NO. : 4,902,142

DATED : February 20, 1990

INVENTOR(S) : Lammert et al.

It is certified that error appears in the above-identified patent and that said Letters Patent is hereby corrected as shown below:

| | |
|---|---|
| Col. 3, lines 34-35 | Delete " adjoining the base of adhesive, the tab (3), " and substitute -- of adhesive, the tab (3), adjoining the base, -- |
| Col. 4, line 2 | Delete " into adhesive " and substitute -- into an adhesive -- |
| Col. 4, line 3 | Delete " region " and substitute -- region (4) -- |
| Col. 4, line 4 | Delete " base " and substitute -- base (2) -- |
| Col. 4, line 5 | Delete " tape " and substitute -- tape (1) -- |

Signed and Sealed this

Fourth Day of February, 1992

*Attest:*

*Attesting Officer*

HARRY F. MANBECK, JR.

*Commissioner of Patents and Trademarks*